United States Patent [19]

Axelrod

[11] Patent Number: 4,565,477

[45] Date of Patent: Jan. 21, 1986

[54] METHOD OF CASING-IN BOOKS

[75] Inventor: Herbert R. Axelrod, Neptune City, N.J.

[73] Assignee: permaTek, Inc., Las Vegas, Nev.

[21] Appl. No.: 617,837

[22] Filed: Jun. 6, 1984

Related U.S. Application Data

[63] Continuation of Ser. No. 321,541, Nov. 16, 1981, abandoned.

[51] Int. Cl.[4] ..... B42C 11/00

[52] U.S. Cl. ..... 412/5; 412/21; 412/22; 412/902; 281/21 R

[58] Field of Search ..... 412/4, 5, 8, 19, 21, 412/22, 902, 3, 20, 23, 24; 281/21 R

[56] References Cited

U.S. PATENT DOCUMENTS

| | | | |
|---|---|---|---|
| 2,098,060 | 11/1937 | Moyer | 412/902 |
| 3,009,180 | 11/1961 | Schramm | 412/22 |
| 3,708,813 | 1/1973 | Carter et al. | 412/22 X |
| 3,888,722 | 6/1975 | Blair | 156/477 B |
| 3,992,741 | 11/1976 | Staats | 281/21 R |
| 4,074,382 | 2/1978 | Palme et al. | 412/22 |
| 4,156,538 | 5/1979 | Roberts | 281/29 |

FOREIGN PATENT DOCUMENTS 2045686 11/1980 United Kingdom .

OTHER PUBLICATIONS

Tete, Technisch Tijdschrift Voor De Grafischi Industrie, vol. 17, No. 2, Mars/Avril, 1962, Amsterdam (NL). J. C. Blankenstein: "Nieuwe Methode Voor in De Band Zetten Van Boeken", p. 19.

*Primary Examiner*—James M. Meister
*Assistant Examiner*—John L. Knoble
*Attorney, Agent, or Firm*—Yuter, Rosen & Dainow

[57] ABSTRACT

A method for bookbinding on a continuously-moving, constant-speed conveyer belt operation with the case or back-strip being centrally located on the axis of motion. As the case is formed between opposing rotary irons, glue or paste is then applied to the upper insides of both sides of the case. A book block is next dropped on one side of the case, the book block is aligned to register with the case; and the other side of the case is folded over to fasten to the upper side of the book block to form the book and prepare it for pressing and crimping of the building-in operation, without any interruption of the motion of the book along the conveyer system.

17 Claims, 6 Drawing Figures

FIG. 4
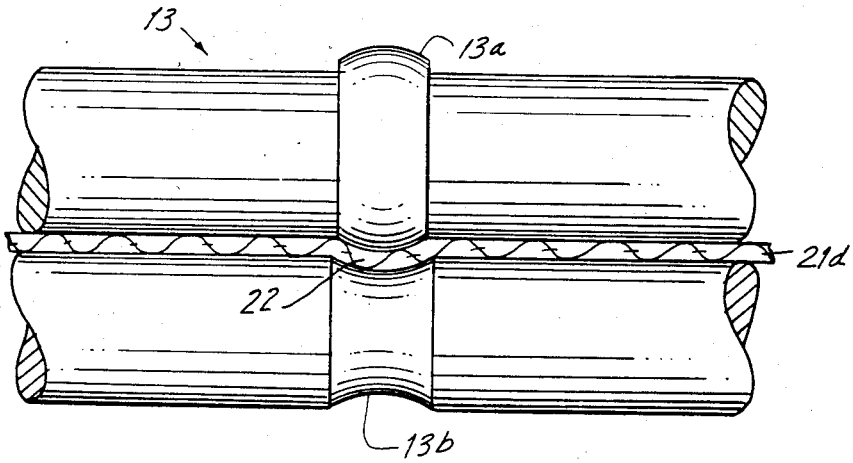
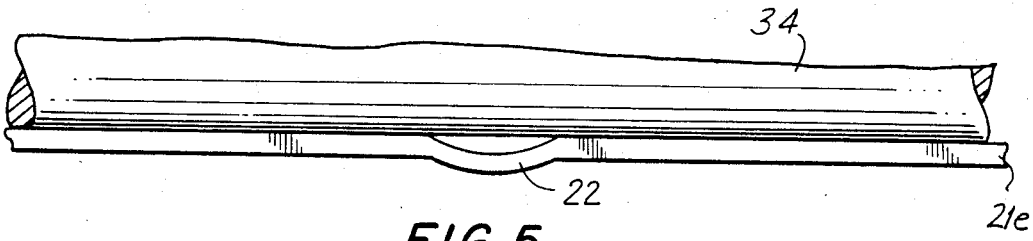
FIG. 5
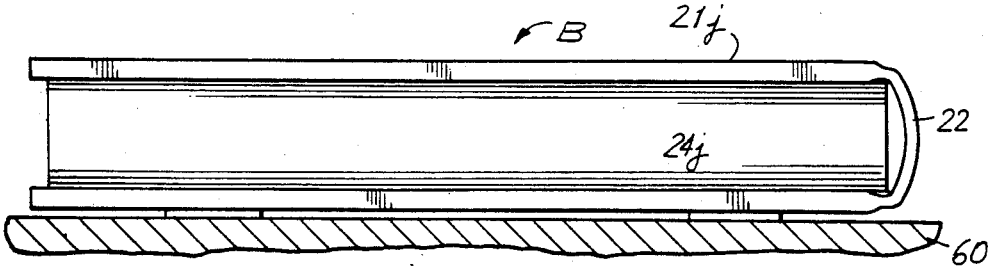
FIG. 6

METHOD OF CASING-IN BOOKS

This application is a continuation of application Ser. No. 321,541 filed Nov. 16, 1981 now abandoned.

BACKGROUND OF THE INVENTION

Of the numerous discrete and separate operations entailed in the manufacture, and specifically the binding, of a hardcover book, "casing-in" is the process in which a book and its hard cover (or "case") are fastened together.

My U.S. Pat. No. 4,091,487, issued May 30, 1978 for a "Method for Binding Books" discloses an important improvement over conventional book binding, wherein the signatures are first collated, the spines or backbones of the signatures are then cut off to provide a single backbone exposing every sheet in every signature, and whose edges can be glued together and to at least one paper cover that will ultimately be glued to the interior surfaces of a conventional hard cover, after the other three edges of the assembled and collated signatures are trimmed.

My U.S. Pat. No. 4,106,148, issued Aug. 15, 1978 for a "Method of Binding Papers", discloses an additional improvement over conventional book binding, wherein notches or apertures are cut into the spines at intervals to permit the flow of adhesive glue well into the backbone of all of the pages in every signature. This method avoids the waste of paper and the extra step of grinding the backbone while still eliminating the even-more-costly step of sewing the signatures.

My co-pending U.S. patent application Ser. No. 145,018 discloses still another method for binding a book wherein the backbone of printed and folded signatures receives a heat activated glue. A short reinforcing cover whose inner surface is also covered with a heat activated glue is applied to the backbone. The outer portions of the short cover are then bonded to the outer pages of the signatures, under sufficient heat and pressure to form a strong bond. A hard cover of suitable size and shape is then glued to the outside of the short cover and the signatures.

The present invention relates to a method for casing-in books which is faster, more economical, and more accurate than conventional casing-in, and which creates a finished hardcover book that is as strong as, or stronger than, books cased-in by the usual methods.

In effect an assembly operation, casing-in uses as raw materials (1) complete books (without hard covers, often referred to as "book blocks"), (2) completed hard covers or "cases", and (3) glue, paste, or some other adhesive to bond the book blocks and cases together. Book blocks and cases are produced in the book bindery, each in a separate and distinct series of operations, prior to casing-in. There are numerous alternative methods and materials that may be employed in both book block-and case productions.

These in-process materials may differ in their appearance or structure. Book blocks, for example, may be bound, inter alia, with adhesives, by needle-and-thread sewing, or mechanically (such as wire-spiral bound or with plastic). Their backbones or spines may be "flat backed" or "round backed", depending upon the shape or configuration of the raw materials, and particularly that of the book blocks. The number and nature of the discrete steps in casing-in may vary in its current art.

Regardless of the types of book blocks or cases used, presently known casing-in is slow and cumbersome, and requires considerable hand labor, requiring four basic steps, i.e.

(1) Glue, paste, or some other adhesive is evenly applied to the outside of both the first and last pages ("endpapers") of the book block. In conventional casing-in equipment, the book block is positioned either manually or mechanically astride a flat, metal, vertical plate called a "wing". The wing then mechanically lifts the book block, drawing it between a pair of rollers that applies the adhesive to the outer endpapers. If the books to be cased-in have a rounded back, a second pair of rollers applies adhesive at the "joints" where the backbone flares out. Finally, if the books are to be "tight backed" (also glued along the spine), still a third application of adhesive is required.

(2) The hard cover, or case, is subjected to heat and pressure at its spine between a male-female set or pair of metal "forming irons" which rounds or curves the cases' spine into conformity with the shape of the book block's spine. In conventional methods, cases are dispensed from a hopper and remain stationary during forming.

(3) The adhesive-coated book block is inserted into the now-formed case in the position in which the two are to be adhered. In prior art equipment, the adhesive application operation and case forming operation are synchronized so the book and cover meet at their respective spines as the book is lifted through the adhesive-dispensing rollers. As the wing continues to rise, the front and back sides of the cover drape around the book block.

(4) The book block and case are pressed together so the glue or paste will bond both together. In some conventional equipment, this step is performed mechanically before the cased-in book is ejected. With other equipment, however, this step must be performed manually by removing and clasping the book block-and-case unit from its wing.

If the now-complete books were permitted to dry as is, they would warp badly. Accordingly, casing-in is immediately followed by a separate and distinct bindery operation called "building-in", in which heat and pressure are applied to the book so it will dry flat.

A number of problems and shortcomings are inherent to the aforedescribed conventional methods for casing-in. In general, conventional casing-in methods are mechanized versions of manual operations, and the equipment used to perform the various steps of casing-in is complex and cumbersome. Book blocks and cases, while being processed, are subject to continuous stopping and starting, and abrupt and awkward movements. This invites questionable and uneven performance, considerable maintenance, slow operation, and recurrent breakdowns, all contributing to high production costs.

Especially in the situation in which adhesive-bound book blocks are to be cased-in, a drying period before casing-in is required to permit the adhesive binding to set. A direct transition from binding to casing-in before the requisite drying period elapses would place undue stress on the adhesive binding, occasioning distortion, mangling, or misalignment of the book and hence considerable spoilage.

Consequently, book blocks are often piled on skids until dry prior to casing-in, thereby causing delays and requiring additional labor. This process, moreover, brings about another problem. The book blocks towards the bottom of the pile tend to become compressed under the natural weight of the book blocks above. The rollers that apply the glue or paste in the casing-in machine, however, must be adjusted and spaced within close tolerances. Accordingly, the casing-in machine's operator must continually stop the equipment to readjust the rollers. Failure to do so accurately results in excessive adhesive application on the thicker book units (called "creepage"), whereby the overabundant adhesive creeps over the edges of the book block and bonds together several outer pages), or insufficient adhesive application on the thinner book blocks towards the bottom of the pile. Depending upon the shape of the book blocks to be cased-in, as many as three sets of rollers must therefore be continually readjusted. The use of multiple pairs of rollers, moreover, requires the waste of larger quantities of adhesive when the "glue pots" are cleaned at the completion of an operating schedule.

In prior art casing-in, it is often necessary for an operator to realign manually the book block within its case after the two have been pressed together. Misalignment occurs frequently because of the abrupt, starting-and-stopping movements inherent in the equipment. In addition to the extra labor required, in some cases the misalignment is so severe that the book block and case must be separated by hand and reprocessed. Before recycling, however, the book block must be allowed to dry to prevent adhesive from fouling the equipment's mechanisms.

In casing-in very thin "juvenile" books (under ¼-inch thick), automatic book block feeding equipment cannot be used. Book blocks must accordingly be manually and individually positioned on the wing by one operator, and a second operator removes the book block-with-case from the wing after processing. Operating speed is therefore limited by both operator's dexterity.

SUMMARY OF THE INVENTION

It is an object of the present invention to provide an in-line method for casing-in books that results in a continuous flow, at a constant rate throughout the actual casing-in of the book with no stop-and-start steps as in the prior art.

It is a further object of the present invention to provide a method for casing-in books that is simpler and considerably faster than existing methods and machines can provide.

It is a further object of the present invention to provide a method for casing-in books that does not require that the adhesive on the spines of adhesive-bound book blocks dry or set before casing-in, and in which the book block may be cased-in as an in-line process from the adhesive-binder, without intermediate drying, stacking, storing, or associated time delays.

It is yet a further object of this invention to provide a method for casing-in books that does not involve creepage due to excess of paste, or rejects due to insufficient past because of variations in the thickness of book blocks in a given batch.

Another object of the present invention is to provide a method for casing-in books wherein the cased-in books do not have to be realigned by hand after casing-in.

It is a further object of this invention to provide a method for casing-in books that requires fewer and simpler steps or mechanical functions and parts and that provides improved precision.

It is yet another object of the present invention to provide a method for casing-in books that permits utilization of machinery that is simpler, less complex, easier to maintain, more durable, and very much less expensive than that required by existing methods and machinery.

It is a further object of this invention to provide a method for casing-in books that requires fewer transfer functions, less supervision, and much less manpower, so as to reduce both time and cost.

It is yet a further object of the present invention to provide a method for casing-in books that can be joined directly in-line to the succeeding building-in operation.

It is another object of this invention to provide a casing-in method that produces hardbound books that are as strong as, or stronger than, hardbound books cased-in by existing methods.

The method of the present invention involves a continuous, linear-flow process for casing-in books, requiring no start-and-stop motions. Hard book covers or cases are first formed by a circular forming iron while the cases remain in motion. Glue or paste is then applied to the entire inside surface of the moving cases. Book blocks are then dispensed horizontally, as unopened units, in proper axial alignment on passing cases. Next, the covers are folded over and the books are closed. Finally, the completed books, while still in motion, are subjected to pressure to adhere the book blocks and cases together.

The glue or adhesive used in the present invention is of a nature such that wherever two surfaces do not come into direct contact, the glue or adhesive dries quickly in both colorless and non-sticky form, thereby preventing adhesive build-up on the inside borders of the hard covers around the book blocks' outer edges.

BRIEF DESCRIPTION OF THE DRAWINGS

FIG. 4 is a horizontal sectional view taken in enlarged scale along line 4—4 of FIG. 2;

FIG. 5 is a horizontal sectional view taken in enlarged scale along line 5—5 of FIG. 2; and FIG. 6 is a horizontal sectional view taken in enlarged scale along line 6—6 of FIG. 2.

DETAILED DESCRIPTION OF A PREFERRED EMBODIMENT

Figure 1:
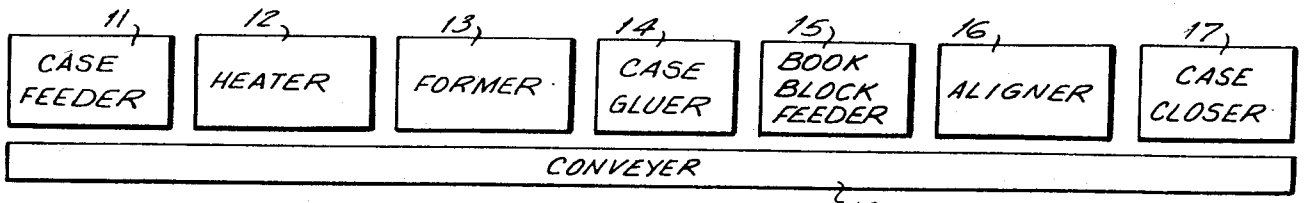
FIG. 1 is a block diagram showing the steps followed in a preferred method embodying the present invention.
Figure 2:
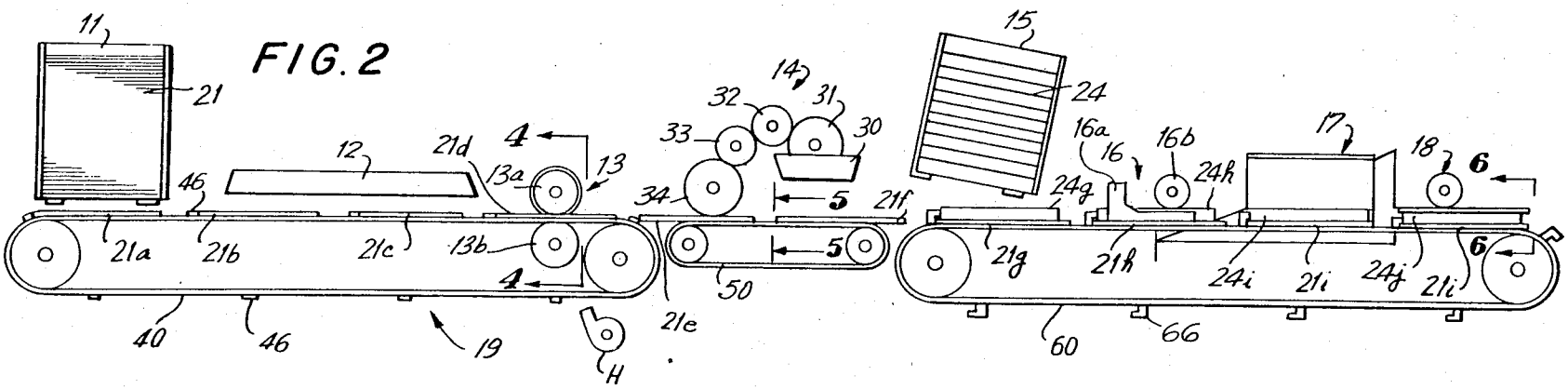
FIG. 2 shows a side view of an apparatus which may be utilized to accomplish said method.
Figure 3:
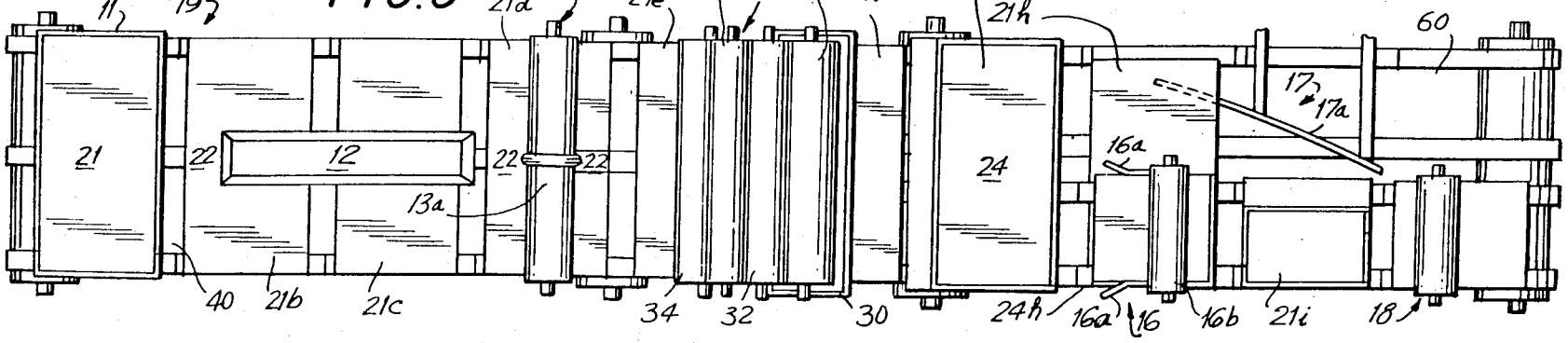
FIG. 3 is a top view of the apparatus of FIG. 2.

The general arrangement of an apparatus which may be utilized to carry out the method of the present invention is disclosed in FIGS. 1, 2 and 3. In FIG. 1 the block diagram shows a case feeder 11 that puts cases with their outside face downward on a constant speed conveyer system, generally designated 19, the cases situated with their inside faces upward. The conveyer then passes the middle, or central backbone portions of the cases under heater 12, to prepare them for a rotary forming iron or former 13. The conveyer next passes the cases under a case gluer 14, and next under a book block feeder 15. The book blocks are next drawn into register with the cases by an aligner 16 before the other side of the case is turned over by a case closer or folder 17.

FIG. 2 is a side view of a suitable apparatus for carrying out a preferred method embodying the present invention. The case feeder 11 is seen loaded with cases 21*a*, 21*b*, etc., that are fed onto a first conveyer belt 40 of conveyer system 19 in timed sequence under the control of a conventional mechanism (not shown). The reference numbers 21*a*, 21*b*, etc. indicate not only a plurality of cases in different phases of casing-in and building-in, but also their locations on the conveyer belt system. A heat lamp heater 12 warms the center portion of the backs of the cases before they are passed between the upper and lower rolls 13*a* and 13*b* of a rotary forming iron 13, at case 21*d* is seen between these rolls in FIGS. 2 and 4. As shown in FIGS. 2 and 5, the formed case 21*e* is then disposed under a gluing roller 34, which is fed by a series of rollers 33, 32, and 31, the latter of which turns in a glue or pastepot 30. This gluing sequence may be motivated by a second shorter conveyer belt 50. A third conveyer belt 60 receives the glued case 21*g* and passes it under a book block feeder 15, which contains a stack of book blocks 24, which fall on the formed, glued cases. Each book block is brought into register along both axes by each aligner 16 with a first outer side of the block against a first side part of the case, before a case closer 17 folds the other side of the case toward the upper or second outer side of the book block to fit on said second side of the book block which is then ready for the final building-in processing.

More particularly, first conveyer belt 40 may have lugs such as 46 for abutting the downstream edge of the cases 21. The second conveyer belt 50 may omit lugs that might interfere with the gluing roller 34. The third conveyer belt 60 may have lugs, such as 66, for moving the cases and cased-in books. FIG. 3 is a top plan view of the apparatus of FIGS. 1 and 2, with similar elements similarly numbered. In this figure cases 21*b* and 21*c* are shown with their center portions or backbones 22 passing under the heater 12 before case 21*d* passes between the rotary forming irons 13*a* and 13*b*. Such irons form backbone 22 (FIG. 4). Case 21*e* passes under the gluing roller 34, which is seen being fed by the intermediary rollers 31, 32 and 33 from the glue pot 30. The case 21*g* now passes under the book block feeder 15 to receive a book block 24*g* which is aligned with one side of case 21*h* by the conventional aligner 16 as shown in FIG. 3. Aligner 16 includes a pair of centering fingers 16*a* and a roller 16*b* to control the book block 24*g*. The case closer or folder 17 next lifts the other side of the case at 21*i* to cover the book block 24*i*. This may be accomplished by an inclined plane such as 17*a*, or a succession of such inclined planes, or other types of conventional folding mechanisms. The casing-in of case 21*j* and its book block 24*j* into book B is now complete, as seen also in FIG. 6.

While a typical, relatively-simple series of mechanisms is shown for performing a preferred method of the present invention other variations of mechanisms could be employed. Also, the sizes and functions of the mechanisms may be varied to accommodate any size and type of book. Almost all types of books from flat to rounded backs and hard to soft covers, and even spiral bound books, could be bound by this method with only slight variations in the mechanisms. By way of example, additional drive belts or wheels (not shown) can also be added above or below the moving cases or book blocks to insure consistent and positive motion of the elements. Flexible strips may be positioned where desirable to hold the elements in close contact with the conveyers, or align the book blocks to the cases. After alignment, a slight pressure may be applied to the book block, and after the other side of the case is folded over, slight pressure may again be applied to the upper case to bond the case to the book block just enough for handling, if necessary, and passing on to the final pressing and crimping stage of the building-in processor.

The conveyer system 19 is shown as having three different stages to provide the preferred means for moving the cases and book blocks through the different steps of the process. However, a single, continuous, conveyer belt, as symbolically represented by the single elongated box 19 in FIG. 1, could be used to provide positive and steady movement of the elements throughout the casing-in process. Driving lugs are desirable in the first and last stages, particularly for the alignment, but they could be lowered within the belts during the gluing stage. Alternately, the conveyer system may consist of a series of parallel, synchronized chains or belts.

The first stage on the belt 40 for forming the backs of the cases 24, although preferred, is actually optional, since the case backs could be preformed in one of several conventional manners before being fed onto conveyer belt 50. Also many flat-backed, softcover, and certain other books, do not require forming. However, where forming is required, the rotary forming iron is probably faster and more efficient than the older methods. Actually, the heating of the cases 21 before they are passed through the rotary forming iron may be accomplished by heating the rotary iron itself. This arrangement could control the amount of heat and direct it to the exact portion of the backbone that is being formed. This could be accomplished by heating the forming irons internally (not shown) or through an external hot-air blower as shown in FIG. 2 at H. Obviously, if a heater is used, the conveyer would have to be open (such as chains) to permit the heat to pass through to the forming irons. This arrangement would also reduce the length of the conveyer, which would obviously be advantageous. In the other stages, too, it could prove advantageous to reduce the space or distance along the conveyer to complete a given step, as well as the spacing between steps. The case folder, for example could be a simple flipping arm, or air gun, activated by the presence of a case, instead of a gradual inclined plane using the motion of the conveyer, and a considerable length of the conveyer, to function.

While the roller method for applying glue or paste is standard, very effective, and highly compatible with this linear system, and flat, consistently thick cases, it is anticipated that other gluing methods may be developed that could be effective.

It should be noted that since the glue is applied to the insides of the cases instead of the outsides of the book blocks, a peripheral rim of glue is left on the inside squares of the cases just beyond the edges of the book block. This would, in operation, dry without interfering with the final building-in steps of the book binding.

Various other modifications and changes may be made with respect to the foregoing detailed description without departing from the spirit of the present invention.

I claim:

1. A method for casing-in a plurality of books, each book comprising book case and book block components, using continuous movement conveyor means having a central axis along its direction of movement for transporting said components, wherein a typical book case has opposite first and second side parts and a central back strip therebetween and opposite inside and outside faces of said side parts and back strip, and a typical book block has opposite first and second outer sides and a spine therebetween, the method for casing-in each book comprising the steps: placing said book case with its outside face downward upon the conveyor means, its inside face upward, and its central back strip aligned generally parallel with said central axis of the conveyor means; forming said central back strip to receive the spine of said book block by heating and then passing said central back strip between a pair of forming pressure rollers; applying glue to said inside face of said book case only once in this method, namely when the book case is in continuous movement as it is moved by said conveyor means after said forming step; placing and aligning said book block with its first outer side upon said glued inside face of said first side part of said book case; folding said glued inside face of said second outer side part of said case over and around the spine of said book block and into contact with said second side of said book block; and applying pressure urging said glued surfaces of said book case and said book block to adhere together.

2. A method for casing-in a book on a constant speed as set forth in claim 1 wherein said book case is put on said conveyer by a feeding mechanism.

3. A method for casing-in a book on a constant-speed conveyer as set forth in claim 1 wherein said central back-strip is heated by a source of heat positioned above said back-strip as it moves along said conveyer.

4. A method for casing-in a book on a constant-speed conveyer as set forth in claim 3 wherein said source of heat is a heat lamp positioned above said back strip as it moves along said conveyer.

5. A method for casing-in a book on a constant speed conveyer as set forth in claim 3 wherein said source of heat is a forced hot-air blower positioned so as to direct hot-air onto said rotary forming irons.

6. A method for casing-in a book on a constant speed conveyer as set forth in claim 1 wherein said glue is applied to the upper insides of said cases by a series of rollers interacting between said case and a glue reservoir.

7. A method for casing-in a book on a constant speed conveyer as set forth in claim 1 wherein said book block is put on said glue on said one side of said casing by an automatic feeding mechanism.

8. A method according to claim 1 wherein said book cases are hard cover cases and said cased-in books are hard cover books.

9. A method for casing-in a plurality of books, each book comprising book case and book block components, using conveyor means having a central axis along its direction of movement for transporting said components, wherein a typical book case has opposite first and second side parts and a central back strip therebetween and opposite inside and outside faces of said side parts and back strip, and a typical book block has opposite first and second outer sides and a spine therebetween, the method for casing-in each book comprising the steps: placing said book case with its outside face downward upon the conveyor means, its inside face upward, and its central back strip aligned generally parallel with said central axis of the conveyor means; heating said central back strip; forming said central back strip to receive the spine of said book block by passing said central back strip between a pair of forming pressure rollers; applying glue to said inside face of said book case only once in this method, namely when the book case is in continuous movement as it is moved by said conveyor means after said forming step; placing and aligning said book block with its first outer side upon said glued inside face of said first side part of said book case; folding said glued inside face of said second side part of said case over and around the spine of said book block and into contact with said second outer side of said book block; and applying pressure urging said glued surfaces of said book case and said book block to adhere together.

10. A method according to claim 9 comprising the further step of moving said book case and book block at a constant speed on said conveyor means during all said steps of casing-in each book.

11. A method according to claim 10 wherein the step of forming said central back strip comprises positioning a source of heat above said central back strip as it is transported by said conveyor means.

12. A method according to claim 9 wherein said step of applying glue comprises positioning a series of rollers to interact between said inside face of said book case and a reservoir containing said glue.

13. A method according to claim 10 wherein said conveyor means comprises a first conveyor belt for transporting said book case while it is heated and formed, a second conveyor for transporting the book case while glue is applied, and a third conveyor where said book block is placed onto said glued book case and cased-in.

14. A method according to claim 9 wherein said conveyor means comprises a single conveyor belt moving at a constant speed.

15. A method for casing-in a plurality of books, each book comprising book case and book block components, using conveyor means having a central axis along its direction of movement for transporting said components, wherein a typical book case has opposite first and second side parts and a central back strip therebetween and opposite inside and outside faces of said side parts and back strip, and a typical book block has opposite first and second outer sides and a spine therebetween, the method for casing-in each book comprising the steps: placing said book case with its outside face downward upon the conveyor means, its inside face upward, and its central back strip aligned generally parallel with said central axis of the conveyor means; heating said central back strip; forming said central back strip to receive the spine of said book block by passing it between a pair of pre-heated pressure rollers; applying glue to said inside face of said book case only once in this method, namely when the book case is in continuous movement as it is moved by said conveyor means after said forming step; placing and aligning said book block with its first outer side upon said glued inside face of said first side part of said book case; folding said glued inside face of said second side part of said case over and around the spine of said book block and into contact with said second outer side of said book block; and applying pressure urging said glued surfaces of said book case and said book block to adhere together.

16. A method according to claim 15 wherein the step of pre-heating said pressure rollers comprises directing forced hot air onto said pressure rollers.

17. A method for casing-in a plurality of books, each book comprising book case and book block components, using conveyor means having a central axis along its direction of movement for transporting said components, wherein a typical book case has opposite first and second side parts and a central back strip therebetween and opposite inside and outside faces of said side parts and back strip, and a typical book block has opposite first and second outer sides and a spine therebetween, the method for casing-in each book comprising the steps: placing said book case with its outside face downward upon the conveyor means, its inside face upward, and its central back strip aligned generally parallel with said central axis of the conveyor means; heating said central back strip; forming said central back strip to receive the spine of said book block; applying glue to said inside face of said book case, namely when the book case is in continuous movement as it is moved by said conveyor means after said forming step; placing and aligning said book block with its first outer side upon said glued inside face of said first side part of said book case; folding said glued inside face of said second side part of said case over and around the spine of said book block and into contact with said second outer side of said book block; and applying pressure urging said glued surfaces of said book case and said book block to adhere together, the step of forming said central back strip comprises pasing said central back strip between a pair of rotary forming irons.

* * * * *